US010465336B2

(12) United States Patent
Aydin

(10) Patent No.: US 10,465,336 B2
(45) Date of Patent: Nov. 5, 2019

(54) METHOD AND COMPOSITION OBTAINING TEXTILES SHOWING WATER-REPELLENCY AND REPELLENCY AGAINST WATER SOLUBLE DIRT

(71) Applicant: OrganoClick AB, Täby (SE)

(72) Inventor: Juhanes Aydin, Södertälje (SE)

(73) Assignee: OrganoClick AB, Täby (SE)

( * ) Notice: Subject to any disclaimer, the term of this patent is extended or adjusted under 35 U.S.C. 154(b) by 889 days.

(21) Appl. No.: 14/774,743

(22) PCT Filed: Mar. 10, 2014

(86) PCT No.: PCT/EP2014/054552
§ 371 (c)(1),
(2) Date: Sep. 11, 2015

(87) PCT Pub. No.: WO2014/139931
PCT Pub. Date: Sep. 18, 2014

(65) Prior Publication Data

US 2016/0024707 A1 Jan. 28, 2016

(30) Foreign Application Priority Data

Mar. 13, 2013 (SE) ..... 1350303

(51) Int. Cl.
*D06M 15/647* (2006.01)
*D06M 13/513* (2006.01)
(Continued)

(52) U.S. Cl.
CPC ..... *D06M 15/647* (2013.01); *D06M 13/513* (2013.01); *D06M 15/6436* (2013.01);
(Continued)

(58) Field of Classification Search
CPC ..... D06M 15/647; D06M 15/513; D06M 15/6436; D06M 15/715; D06M 23/04;
(Continued)

(56) References Cited

U.S. PATENT DOCUMENTS 4,648,904 A 3/1987 DePasquale et al.
4,990,377 A 2/1991 Wilson
(Continued)

FOREIGN PATENT DOCUMENTS

FR 2735705 A1 12/1996
JP 2007-100247 * 4/2007
(Continued)

OTHER PUBLICATIONS

Machine translation of JP 2007-100247, Apr. 2007.*

*Primary Examiner* — Robert S Walters, Jr.
(74) *Attorney, Agent, or Firm* — Drinker Biddle & Reath LLP

(57) ABSTRACT

An application method of enhancing the water repellence of a textile and/or enhancing a textiles ability to repel water soluble dirt, includes the steps of:

a) applying an emulsified liquid composition on a textile, wherein said emulsified liquid composition includes only water, alkylalkoxysilane with said alkyl chain having a length of 10-30 carbons or carbon atoms higher than 12 but equal to or less than 18, at least one emulsifier, surfactant, thickener and/or stabilizer, a water soluble acid catalyst, and unavoidable impurities;

b) optionally adding to the composition amino silicones for softness and durability enhancement of the water repellency;

c) optionally adjusting the amount of the composition applied on textile;

d) drying the treated textile until dry;

(Continued)

e) curing the treated textile at a temperature of between 100-200° C.; and f) optionally removing the non-reacted composition residue from the treated textile by washing with water and optionally redrying the treated textile.

25 Claims, 1 Drawing Sheet

(51) Int. Cl.
*D06M 15/643* (2006.01)
*D06M 15/715* (2006.01)
*D06M 23/04* (2006.01)

(52) U.S. Cl.
CPC ..... *D06M 15/715* (2013.01); *D06M 23/04* (2013.01); *D06M 2200/01* (2013.01); *D06M 2200/12* (2013.01); *D06M 2200/50* (2013.01); *D06M 2400/01* (2013.01)

(58) Field of Classification Search
CPC ..... D06M 2200/01; D06M 2200/12; D06M 2200/50; D06M 2400/01
See application file for complete search history.

(56) References Cited

U.S. PATENT DOCUMENTS

| | | | | |
|---|---|---|---|---|
| 5,000,861 | A | 3/1991 | Yang | |
| 5,274,159 | A * | 12/1993 | Pellerite | B01F 17/0071 556/485 |
| 5,552,476 | A | 9/1996 | Halling | |
| 6,147,157 | A * | 11/2000 | Inokuchi | C08K 5/5455 524/588 |
| 2007/0237901 | A1 | 10/2007 | Moses et al. | |
| 2009/0074971 | A1 | 3/2009 | McMahon et al. | |
| 2009/0206296 | A1 | 8/2009 | Dave | |
| 2011/0021098 | A1* | 1/2011 | Tabellion | C03C 17/007 442/80 |
| 2013/0189530 | A1* | 7/2013 | Thompson | C04B 24/42 428/447 |
| 2013/0190429 | A1 | 7/2013 | Lewis et al. | |

FOREIGN PATENT DOCUMENTS

| | | | |
|---|---|---|---|
| JP | 2007-100276 | A | 4/2007 |
| SE | 534473 | C2 | 9/2011 |
| WO | WO-2011/086012 | A1 | 7/2011 |

* cited by examiner

METHOD AND COMPOSITION OBTAINING TEXTILES SHOWING WATER-REPELLENCY AND REPELLENCY AGAINST WATER SOLUBLE DIRT

CROSS-REFERENCE TO PRIOR APPLICATION

This application is a § 371 National Stage Application of PCT International Application No. PCT/EP2014/054552 filed Mar. 10, 2014, which claims priority to Swedish Patent Application No. 1350303-2 filed Mar. 13, 2013, which is herein incorporated by reference in its entirety.

FIELD OF INVENTION

The present invention relates to a method and a water-based chemical composition for obtaining extremely water-repellent textiles, with good washing and/or weathering-durability.

SUMMARY OF THE INVENTION

This invention relates to a method of treating textiles with an aqueous silane emulsion and a method for its preparation.

Industrially the aqueous silane emulsion according to the invention is applied to the fabric or textile yielding a durable highly water repellent fabric.

The applied emulsion according to the invention comprises an alkoxy silane, an acid, an emulsifier system of at least one emulsifier and water. The emulsion according to the invention is stable over time without separation into two phases. This invention offers an alternative method to the use of fluorine-based compounds for the treatment of textiles to achieve water-repellency, by providing a water based silane composition and a specific application process. The inventive composition is the result of the selection of a hydrophobizing agent (silane), an (acid-based) catalyst, emulsifier(s) and water as solvent.

It is shown that the composition may be applied in industrially relevant process times rendering highly durable and water-repellent textiles.

The present invention relates to an application method of enhancing the water repellence of a textile and/or enhancing the ability of a textile to repel water soluble dirt, comprising the steps of:

a) Applying an emulsified liquid composition on a textile, wherein said emulsified liquid composition consists of:
- Water
- Alkylalkoxysilane with said alkyl chain having a length of 10-30 carbons or carbon atoms higher than 12 but equal to or less than 18
- At least one emulsifier, surfactant, thickener and/or stabilizer.
- a water soluble acid catalyst and
- unavoidable impurities b) Optionally adjusting the amount of formulation applied on the textile c) Drying the treated textile until dry d) Curing the treated textile at a temperature of between 100-200° C.

e) Optionally removing the non-reacted formulation residue from the treated textile by washing with water and optionally redrying the treated textile.

According to an alternative method, amino silicones are added for softness and durability, whereby the steps are the following:

a) Applying an emulsified liquid composition on a textile, wherein said emulsified liquid composition consists of:
- Water
- Alkylalkoxysilane with said alkyl chain having a length of 10-30 carbons or for example 12-30 carbons
- At least one emulsifier or thickener or surfactant or stabilizer
- a water soluble acid catalyst;
- and unavoidable impurities b) Optionally adding to the composition amino silicones for softness and durability enhancement of the water repellency c) Optionally, adjusting amount of formulation applied on textile d) Drying the treated textile until dry e) Curing the treated textile at a temperature of between 100-200° C.

f) Optionally, removing the non-reacted formulation residue from the treated textile by washing with water and then optionally redrying The present application method according to the invention may comprise any of the following determinations or features in any combination;

An application method according to the invention wherein said emulsified liquid composition has a pH less than 4.5 or between 1.8-4.3 or between 1.9-4.2.

An application method according to the invention wherein said way of applying said emulsified liquid composition is selected from soaking, impregnating, padding, dipping, spraying, brushing, coating, rolling, foam-application, impregnation, vacuum-pressure impregnation process or by other means applying said liquid composition.

An application method according to the invention wherein adjusting the amount of composition applied on textile is made using an industrial padding machine/foulard to apply the emulsion to the substrate and to control the wet uptake by adjusting the nip pressure or pneumatic load adjustment of the rolls and wherein the wet uptake is 30-100%. w/w % in relation to untreated textile.

An application method according to the invention wherein said alkylalkoxysilane in said emulsified liquid composition is added in a concentration of 2-10 w/w % in relation to the total amount of emulsified solution.

An application method according to the invention wherein said acid catalyst in said emulsified liquid composition is at a concentration of <8 w/w % or between 0.01-7 w/w % in relation to the total amount of emulsified solution.

An application method according to the invention wherein said emulsifier or a combination of said emulsifiers in said emulsified liquid composition is at concentration of <2 w/w % or between 0.9-1.1 w/w % in relation to the total amount of emulsified solution.

An application method according to the invention wherein said water content in said emulsified liquid composition is 80-97.5 w/w % or 87-94 w/w % in relation to the total amount of emulsified solution.

An application method according to the invention wherein said water content in said emulsified liquid composition is lower than 80 w/w % or between 20-80 w/w % in relation to the total amount emulsified solution and wherein additional amount of water may be added before use of said application method.

An application method according to the invention wherein in said alkylalkoxysilane the alkoxy groups are selected from acetoxy, methoxy, etoxy, n-propoxy, isopropoxy, n-butoxy, isobutoxy or tert butoxy.

An application method according to the invention wherein said alkylalkoxysilane in said emulsified liquid composition is selected from the group having an alkyl chain with a number of carbon atoms higher than 12 but equal to or less than 18 carbons.

An application method according to the invention wherein the alkylalkoxysilane is selected from n-, iso or mixtures thereof of hexadecyltrimethoxysilane and/or octadecyltrimethoxy silanes.

An application method according to the invention wherein the alkyl group of said alkylalkoxysilane is a linear, branched or cyclic carbon chain or a unsaturated and saturated carbon chain.

An application method according to the invention wherein said alkylalkoxysilane is selected from n- or iso configured hexadecyl trimethoxysilane, hexadecyl triethoxysilane or n-octadecyl trimethoxy silanes or mixtures thereof.

An application method according to the invention wherein said emulsified liquid composition has a pKa of less than 3.9 or between 1.9-3.9.

An application method according to the invention wherein said water soluble acid catalysts in said emulsified liquid composition has a pKa of 6 or less, or pKa of 14–4

An application method according to the invention wherein said emulsifier in said emulsified liquid composition is a non-ionic, cationic or anionic emulsifier.

An application method according to the invention wherein the acid catalyst is a Lewis- or a Bronstedt acid.

An application method according to the invention wherein the acid catalyst is an organic or inorganic acid.

An application method according to the invention wherein the acid catalyst is chosen from any of para-toluenesulfonic acid, benzenesulfonic acid, camphorsulfonic acid, malic acid, maleic acid, glyoxylic acid, citric acid, formic acid, pyruvic acid, tartaric acid, phtalic acid, acetylsalicylic acid, salicylic acid, lactic acid, dihydroxy fumaric acid, mandelic acid, malonic acid, glycolic acid, acetic acid, hydrochloric acid, sulfuric acid and oxalic acid.

An application method for rendering a textile durable water repellent and/or water soluble dirt repellent according to the invention wherein drying the treated textile is performed at a temperature of between 15-180° C. or between 15-170° C. until dry.

An application method for rendering a textile durable water repellent and/or water soluble dirt repellent according to the invention wherein curing the treated textile is performed at a temperature of between 100-180° C. or between 150-180° C. For equal or less than 5 minutes, for example for 0-5 minutes.

Further this invention also relates to;

An emulsified liquid composition used in the application method according to the invention.

A textile which is durable water repellent and water soluble dirt repellant treated using the application method according to the invention.

A textile according to the invention wherein the textile has an ISO 4920 spray test result of ISO 3 or higher after five or more washes of said textile.

Use of the emulsified liquid composition according to the invention according to the application method according to the invention to make a textile durable water resistance Use of a emulsified liquid composition according to the invention according to the application method according to the invention to make a textile durable dirt repellant towards water soluble dirt, for example wine, ketchup, coffee or soil.

Throughout the specification the word composition has been used for identifying a formulation for use in a method of obtaining textiles, which are water repellant and/or water soluble dirt repellent.

BACKGROUND OF THE INVENTION

Durable water repellent finishes are hydrophobic coatings that are applied to textiles to make them water-resistant. However, despite the name, most durable water repellent finishes on the market tend to wear off with time and show very poor durability in harsh conditions (e.g. a textile washing process or in an acidic environment). Several inventions have been developed in order to obtain textiles with water repellent properties. The known methods give however textiles with poor wear resistance and washing durability and are somewhat difficult to apply onto the material. The reason for the unacceptable wash resistance of the mentioned systems is the weak attachment of the hydrophobizing agent to the textile fibers. Hence, to achieve persistent water-repellency in textiles, it is imperative for the water-repellent coating to form strong covalent bonds to the fibers, with the additional requirement of them withstanding the harsh conditions in e.g. house-hold washing machines or out-doors. While obvious, it is not a straight forward matter to produce these bonds, as very few, if any, hydrophobizing compositions (for treatment of e.g. cellulosic fabrics) fulfill the combined requirements of formation of covalent bonds that withstand high alkaline conditions (pH>10) at high temperatures (≥40 C.°), industrial relevant application times of the formulation, acceptable cost and a non-hazardous application process; not to mention non or little impact on the environment.

For decades, the application of fluorine compounds has been the route of choice in the manufacturing of e.g. water-repellent clothing. The success of fluorocarbons is due to their extreme hydrophobicity and oleophobicity, their extremely low surface tension and their tendency to remain on the textile. But despite its proven effectiveness, the application of "fluorocarbons" is highly controversial, due to its negative impact on the environment and to studies[1] on animals showing that accumulated fluorocarbons (in the body) can be extremely hazardous.

The potential of (non-fluorinated) organosilanes, which are derivatives of silanes containing at least one carbon to silicon bond, to render water repellency to surfaces has been known for some time. Particularly, the so called alkoxysilanes and silicon halides (which have at least one hydrophobic moiety and one to three hydrolysable alkoxy and halide groups respectively) have long been regarded as potential candidates for rendering water-repellency to hydroxyl bearing surfaces (e.g. cellulose containing materials). This view is based on the knowledge that in the presence of water the reactive groups (alkoxy/halides) of organosilanes hydrolyze to form hydroxyl (OH) groups. These groups (in theory) promote the adsorption of the silanes to the OH-bearing surface through a hydrogen bonding mechanism. The silanes can subsequently be covalently attached to the surface through a heating process leading to the release of water.

However, the hydrolyzed monomeric organosilanes are highly reactive and are known to undergo condensation reactions (in the solution), leading to the formation of polymeric structures (and gels during prolonged times). Also, the high reactivity of the mentioned silanes (specially the silicon halides) requires the undertaking of highly complex measures (to ensure "dry" water-free conditions) to maintain the silanes in their reactive form, something that up to date has been considered as too complicated and not economical. Accordingly, there are very few patents available that deal with the hydrophobization of textile with (non-fluorinated) organosilanes. Even fewer patents put emphasis on the resulting washability/durability. From the above it is clear that non-fluorinated durable water repellent finishes have to be/remain firmly attached to the substrate, especially under "normal" washing conditions, before they can be regarded as possible alternatives for the "fluorine equivalents". It is further clear that employing organosilanes is not an easy task due to their high reactivity, which to the best knowledge of the inventors up to date has made their application impractical. What is also unattractive from an economical, environmental and practical point of view is the use of organic solvents, such as alcohols, in the application of organosilanes or fluorocarbons. Further, the application of organosilanes must be affordable, industrially feasible, and be more environmentally friendly than the existing "fluorine coating" processes. Additionally, hazardous solvents should be avoided and instead the use of water promoted. The general objective in preparing a water based composition for rendering textile water repellent, is to devise a system in which the reactivity of the organosilane is maintained over a long period of time, making use and storage of said composition practically, economically and environmentally feasible.

It is also important that the process is more environmentally friendly than the current silane processes, which comprises use of different solvents. There is also a need for a durable coating which stays on the fabric after washing. Currently there is no hydrophobization process which fulfills all (or at least the majority) of the stated requirements. This has been the motivation for the work leading to this invention. In what follows, a novel organosilane composition together with its application process, which is believed to fulfill the stated requirements, will be presented.

PRIOR ART

In the patent application PCT/EP2011/050066 the inventor describes a method in which organosilanes are utilized for making cellulosic fibers hydrophobic. In this process alcohols or organic solvents can be used. Also a strong acid of $pK_a<1.0$ is employed as catalyst which has to be removed after the material has been treated in order for the water repellency to be good. The use of organic solvents and alcohols along with the use of very strong acids are impractical from an industrial point of view both in terms of corrosion, health aspects, flammability, and explosion risk and also in terms of the negative effect on the esthetical and mechanical properties of the treated material caused by the strong acid. Additionally the acid must be rinsed away in order for the water repellent effect to take place, which is not always practical depending on the material that has been treated.

In patent application US2009206296 the silane compositions described comprise a solvent which is used in order dissolve the composition components. As stated earlier the use of organic solvents or alcohols is impractical due to flammability, toxicity etc from an industrial- and health point of view. Additionally low spray test results along with the lack of washability limit their usefulness in the production of durable water repellent textiles.

Other documents showing examples of silane compositions and uses are; U.S. Pat. No. 5,552,476, JP2007100276, FR2735705, US2007237901, U.S. Pat. No. 4,990,377.

DESCRIPTIONS OF THE FIGURES

OBJECTS OF THE INVENTION

Figure 1:
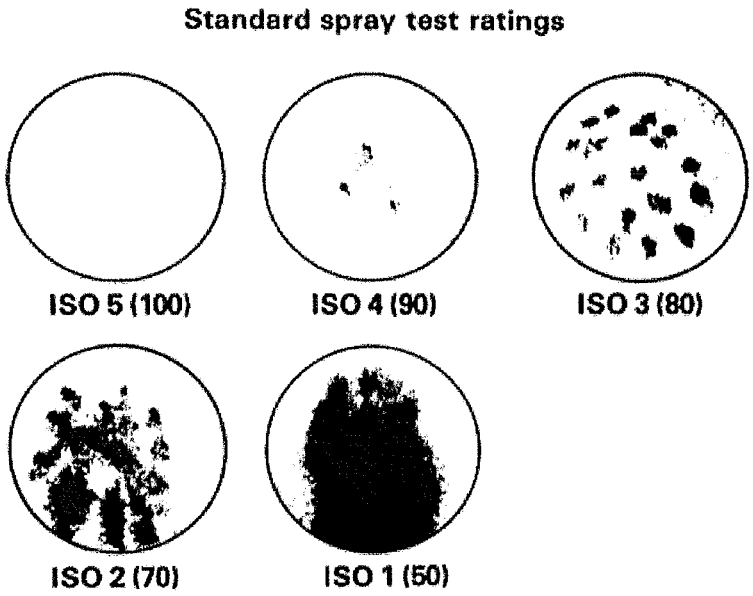
FIG. 1 Shows criteria for different scales using the ISO 4920 spray test

It is an object of the invention to provide an environmentally friendly, industrially applicable method for treating a textile in order to achieve a durable water-repellency and/or repellency for water soluble dirt.

It is a further object of the present invention to provide a chemical composition composed of a liquid solution consisting of a hydrophobizing agent in the form of an organosilane, an acidic catalyst, a single or combination of emulsifiers/surfactants/thickeners/stabilizers and only water as solvent.

A further object of the present invention is an application method comprising a silane-water based composition, stable over a long period of time, with the aid of a suitable emulsifier system, containing a catalyst which has a pKa that does not interfere in too large extent with the water repellency nor the esthetic and mechanical properties of the substrate that has been treated, containing an emulsifier system which emulsifies the organosilane efficiently in water without interfering with the stability of the composition in a negative way or without interfering with the esthetic or mechanical properties nor reducing the reactivity of the silane over time.

Another object of the invention is to provide a method of this kind, which is attractive from an economic and environmental standpoint A further object of the invention is to provide means to industrially use the method and the chemical formulation in current production methods of textile.

These and other objects, features and advantages of the herein described invention will become more apparent from the following detailed description thereof.

DETAILED DESCRIPTION OF THE INVENTION

According to the invention a method is disclosed for improving water repellency of textiles comprising wetting the material in a liquid composition comprising or consisting of an organosilane as hydrophobizing agent, an acid functioning as catalyst, a surfactant functioning as an emulsifier and water as solvent, drying and curing the fiber based material at an elevated temperature for a time sufficient to obtain the desired improvement. According to the invention the use of the wording textiles according to the present invention may include textiles, cloths or fabrics and may according to the present invention be natural and/or synthetic textiles and/or woven and/or non-woven textiles and mixtures thereof. Textiles may consist of a network of natural and/or artificial fibers often referred to as thread or yarn. Yarn is produced by spinning raw fibers of wool, flax, cotton, or other material to produce long strands. Textiles are formed by weaving, knitting, crocheting, knotting, or pressing fibers together (felt).

The words fabric and cloth may for example be used in textile assembly trades (such as tailoring and dressmaking) as synonyms for textile. Textile may refer to any material made of interlacing fibers or non woven textiles. Fabric refers to any material made through weaving, knitting, spreading, crocheting, or bonding that may be used in the production of further goods (garments, etc.). Cloth may be used synonymously with fabric but often refers to a finished piece of fabric used for a specific purpose (e.g., table cloth). The wording textiles according to the present invention may include all different types of textiles described above. Textiles according to the invention can be made from many different types of materials and fibers for example animal (wool, silk, mohair, cashmere, pygora, cameldown, alpaca, ilama, vicuna, guanaco, angora or qiviut etc), plant (ramie, nettle, milkweed, cotton, linen, flax, jute or hemp) wood; e.g. viscose, etc), mineral (asbestos, glass fiber etc), and synthetic (nylon, elastan, polyester, acrylic, polyamide, polypropylene, polyurethane and its derivatives, etc) and sugar based (cornfiber, coir, yucca, sisal or bamboo (rayon) fiber etc) or protein based fibers from plants (peanut and soybased, chitin based, milk casein based, keratin based or poly lactic acid based). The textile suitable for treatment according to the present invention is preferably a washable textile.

The method of application of the emulsified solution or composition to the textile according to the invention may be by soaking or dipping or spraying otherwise applying the composition on the textile for example by using a padding machine or a stenter frame or other machine or for example manually.

The wording unavoidable impurities may according to this invention for example include small amounts of chemicals which is unavoidable due to that they are present in small amounts in the added ingredients.

The treated textile treated using the application method according to the present invention have an excellent durable water repellency, even after washing of the garment (with or without detergent). The water repellency after three washes is higher than 3 according to the ISO 4920 spraying test in which the fabric is subjected to a standardized amount of water that is sprayed onto the fabric, mimicking a rain shower.

The treated textile also shows excellent dirt repellency, especially repellency for water soluble/hydrophilic dirt for example but not limited to soil stains or stains of ketchup, coffee or wine or water soluble stains.

The present invention also includes the use of the emulsified solution according to the invention for rendering a textile durable water repellent and/or dirt repellant.

The wording rendering a textile durable water resistance or water repellant and/or dirt repellant in the present application means that the textile is water resistance or water repellant and/or dirt repellant also after having been washed 5 times or more. A sufficient amount of silane is covalently attached to the coated textile which means that it withstands normal washing conditions without losing its water repellency after wash.

The Emulsified Liquid Composition

The wording emulsified solution or emulsified liquid composition is used referring to the solution which is used to treat the textile in order to make the textile durable water resistant and/or dirt repellent. The said emulsified liquid composition according to the invention comprises or consists of an alkylalkoxysilane as hydrophobizing agent, an acid functioning as catalyst, an emulsifier and water as solvent. The emulsified liquid composition according to the invention comprises alkylalkoxysilanes which keeps their reactivity also while storing the formed emulsified liquid composition according to the invention. In one embodiment, the emulsified liquid composition according to the invention may be stored for at least 6 months at room temperature without that the comprised alkylalkoxysilanes loses their reactivity.

The emulsified liquid composition according to the invention consists of:

Water

Alkylalkoxysilane with said alkyl chain having a length of 10-30 carbons or 12-30 carbons At least one emulsifier/surfactant/thickener/stabilizer a water soluble acid catalyst;

and unavoidable impurities

The ingredients of the liquid composition according to the invention may have any characteristics according to the different alternatives disclosed below:

Hydrophobizing Agent:

The hydrophobizing agent according to the invention is selected from the group of alkylalkoxysilanes and may have any characteristics according to the different alternatives disclosed below.

In one embodiment, the alkoxy group of the alkylalkoxysilane of the liquid composition according to the invention is chosen from alkoxy groups comprising 1-4 carbons or for example comprising 2-3 carbons, or for example selected from acetoxy, methoxy, ethoxy, propoxy(for example n-propoxy, isopropoxy) or butoxy groups (for example n-butoxy, isobutoxy or tert butoxy). In one embodiment, the alkylalkoxysilane of choice in the preferred composition is chosen from the class of alkyltrialkoxysilanes for example n-, iso or mixtures thereof, of hexadecyltrimethoxy silane and octadecyltrimethoxy silane (examples of suitable hexadecyltrimethoxy silanes, may be one comprising linear carbon chains or is called n-hexadecyltrimethoxy silane or a branched silane iso-hexadecyltrimethoxy silane alternatively a mixture of branched and linear silane is useful; hexadecyltrimethoxy silane, mixture of isomers). In other embodiments the alkylalkoxysilane according to the invention is an organosilane further comprising a quaternary ammonium alkyl group such as Dimethyloctadecyl[3-(trimethoxysilyl)propyl]ammonium chloride, Dimethylhexadecyl[3-(trimethoxysilyl)propyl]ammonium chloride or related compounds differing in the anion. For example chloride can be exchanged with bromide, iodide, acetate or similar. Dimethyl can also be replaced by other alkyl groups such as ethyl, propyl, butyl, pentyl hexyl or phenyl.

In one embodiment the emulsified composition according to the invention comprises an alkylalkoxysilane with an alkyl chain with a number of carbon atoms higher than to but equal to or less than 30 carbon atoms. Said alkyl chain on the alkylalkoxysilane is for example a straight and saturated carbon chain to allow better packing of the chains at the cellulosic material interface, but branched, cyclic and/or non-saturated chains are also conceivable according to the invention. According to other embodiments the emulsified composition according to the invention comprises an alkylalkoxysilane with an alkyl chain with a number of carbon atoms higher than to but equal or less than 30, or for example with a number of carbon atoms higher than 12 and less than 30 or for example with an alkyl chain with a number of carbon atoms higher than 16 and less than 18.

In another embodiment the emulsified composition according to the invention comprises an organosilane with an alkyl chain which is linear or cyclic with a number of carbon atoms larger than 10 but equal or less than 30, or for example with a number of carbon atoms higher than 12 and less than 30 or for example with an alkyl chain with a number of carbon atoms larger than 16 and less than 18.

In one embodiment the alkylalkoxysilane, said alkyl is straight or branched, saturated or unsaturated $C_{10}$-$C_{30}$ alkyl, or $C_{12}$ to $C_{18}$ alkyl and the alkoxy group is a acetoxy, methoxy, ethoxy, propoxy (for example n-propoxy, isopropoxy) or butoxy groups (for example n-butoxy, isobutoxy or tert butoxy).

Said alkyl chain on the alkylalkoxy silane is preferably straight and saturated to allow better packing of the chains at the cellulosic material interface, but branched, cyclic and/or non-saturated chains are also conceivable. More preferred is an alkyltrialkoxysilane wherein said alkyl is straight or branched $C_{12}$-$C_{18}$ alkyl. Most preferred is alkyltrialkoxysilane wherein said alkyl is straight or branched $C_{16}$-$C_{18}$ alkyl, for example hexadecyltrimethoxysilane and/or octadecyltrimethoxysilane.

In a preferred embodiment according to the invention, the concentration of the alkylalkoxysilane in the composition shall be in the range of 1-15 w/w %, or between 2-10 w/w % or between 2-8 w/w % or between 4-8 w/w % for example 5-7.5% w/w % compared to the total amount of composition in order to provide excellent hydrophobicity and composition stability (during the fiber modification process).

Acid Catalyst

The acid catalyst comprised in the emulsified composition according to the invention is selected from a Brønsted acid or a Lewis acid. In one embodiment the acid catalyst comprised in the emulsified composition according to the invention is chosen from the class of acids which are readily soluble in water solvent, with the additional requirements of pKa<4, and being active within the system throughout the application process. Additionally the chosen acid should not interfere with the water repellency effect of the material after treatment. In another embodiment the pKa of the acid catalysts is between 1.5-4.0 or between 1.9-3.9. A pKa of the acid catalysts below 1.9 may lead to discoloring of the textile but still give good effect of water repellency and dirt repellency. The catalyst of choice in the formulation is chosen from the group of acids which are readily soluble in water. The catalysts should have pKa<4 and they must remain active within the system during the application process. In one embodiment of the invention the acid is selected from an organic acid. Examples of acidic catalysts that are useful to be comprised in the emulsifying composition according to the invention are para-toluenesulfonic acid, benzenesulfonic acid, camphorsulfonic acid, malic acid, maleic acid, glyoxylic acid, citric acid, formic acid, pyruvic acid, tartaric acid, phtalic acid, acetylsalicylic acid, salicylic acid, lactic acid, dihydroxy fumaric acid, mandelic acid, malonic acid, glycolic acid and oxalic acid. In one embodiment of the invention the acid is selected from an organic acid which is non-toxic. In a preferred embodiment of the invention, the amount of catalyst is equal or less than 8% (w/w). In the most preferred embodiment of the invention, catalysts with pKa less than 4 or pKa between 1.9-3.9 are used; the amount of the acid catalyst in the composition is then less than 7 w/w % or between 1-7 w/w % in relation to the emulsified liquid composition.

Emulsifier

The wording emulsifier may according to the present invention also refer to a surfactant, a thickener or a stabilizer. An emulsifier may be ionic or non-ionic. The emulsifier is added to the emulsified liquid composition in order to emulsify the liquid composition. The emulsifier may be chosen to not discolor the chosen textile material and/or to not affect the strength of the textile. The emulsifier may be chosen from the class of surfactants which is non-ionic emulsifiers having HLB values between 7-41 and that have the ability to emulsify the hydrophobizing agent and the acid catalyst in water. In one embodiment according to the invention the emulsifier is a surfactant with a HLB value between 10-18 which may be used together with surfactants with HLB values between 35-41. In one embodiment the emulsifier is not affecting the reactivity of the catalyst and the hydrophobizing agent. According to the most preferred embodiment of the invention, surfactants with HLB 11-17 and/or 39-41 are used.

In one embodiment the emulsifier is a surfactant that has an HLB value 1-41, selected from any of or a combination of any of;

carboxylic acids having 9-20 carbon atoms; aliphatically substituted benzene/aromatic sulfonic acids having at least 6 carbon atoms in the aliphatic substituents; aliphatic sulfonic acids having at least 6 carbon atoms in the aliphatic substituents; aliphatically substituted diphenyl ether sulfonic acids having at least 6 carbon atoms in the aliphatic substituents; alkyl hydrogen sulfates having at least 6 carbon atoms in the alkyl substituents; alkyl and alkylarylether sulfates having at least 6 carbon atoms in the hydrophobic radical and 1 to 40 ethylene oxide (EO) and/or propylene oxide (PO) units; taurides; esters and monoesters of sulfosuccinic acid with monohydric alcohols or alkylphenols having 4 to 15 carbon atoms, optionally ethoxylated with from 1 to 40 EO units; and also alkali metal and ammonium salts of the acids mentioned; phosphoric partial ester and their alkali metal and ammonium salts, particularly alkyl and alkylaryl phosphates having 8 to 20 carbon atoms in the organic radical; alkyl ether and alkylaryl ether phosphates having 8 to 20 carbon atoms in the alkyl radical and alkylaryl radical respectively and from 1 to 40 EO units; salts of primary, secondary and tertiary fatty amines having 8 to 24 carbon atoms with acetic acid, sulfuric acid, hydrochloric acid and phosphoric acids; quarternary alkyl- and alkylbenzeneammonium salts, more particularly those whose alkyl chain has up to 18 carbon atoms, specifically the halides sulfates phosphates and acetates; alkyl polyglycol ethers, preferably those having from 3 to 40 EO units and alkyl radicals of 8 to 20 carbon atoms, alkylaryl polyglycol ethers, preferably those having from 5 to 40 EO units and from 8 to 20 carbon atoms in the alkyl and aryl radicals; ethylene oxide-propylene oxide (EO-PO) block copolymers, preferably those having from 8 to 40 EO and/or PO units; addition products of alkylamines having alkyl radicals of 8 to 22 carbon atoms with ethylene oxide or propylene oxide; alkylpolyglycosides; natural substances and derivatives thereof, such as lechithin, lanolin, saponines, cellulose; cellulose alkyl ethers and carboxyalkylcelluloses; linear organo(poly)siloxanes containing polar groups containing more particularly the elements O, N, C, S, P, more particularly those having alkoxy groups having up to 24 carbon atoms and/or up to 40 EO and/or PO groups; amino acids substituted with long chains substituents such as N-alkyldi(aminoethyl)glycine or N-alkyl-2-aminopropionic acid salt; betaines, such as N-(3-acylamidopropyl)-N,N-dimethylammonium salts having a C8-C18 acyl radical and alkylimidazolium betaines.

As is known in the art, in addition to the above compounds, examples of stabilizers may also include; hydrogen chloride (HCl) and sodium hydroxide (NaOH).

Non-rewetting, thermally degradable or volatile surfactants such as amine oxide based can also be used in the repellent finish bath to maximize the final properties of the treated substrate.

Water

Water is present in the emulsified liquid composition as a solvent, for example in amounts of 80-97 w/w %.

In an embodiment according to the invention the emulsified liquid according to the invention is a concentrated liquid, comprising water amounts lower than for example 80% and is diluted to comprise 80-97 w/w % of water before use.

Amino Silicones

For the purposes of the present invention, the term "amino silicone" means any silicone comprising at least one primary, secondary or tertiary amine function or a quaternary ammonium group.

Amino silicones that may be optionally used in the durable water repellency composition according to the present invention for obtaining softness and durability enhancement of the water repellency are chosen from:

(a) compounds corresponding to formula (I) below:

(R1)a(T)3.aSi[OSi(T)2]n[OSi(T)b(R1)2.b]mOSi(T)3.a(R1)a (I)

in which:

T is a hydrogen atom or a phenyl, hydroxyl (—OH) or C1-C8 alkyl group, and preferably methyl, or a C1-C8 alkoxy, preferably methoxy, a denotes the number 0 or an integer from 1 to 3, and preferably 0, b denotes 0 or 1, and in particular 1, m and n are numbers such that the sum (n+m) can range especially from 1 to 2000 and in particular from 50 to 150, it being possible for n to denote a number from 0 to 1999 and in particular from 49 to 149, and for m to denote a number from 1 to 2000 and in particular from 1 to 10, R1 is a monovalent group of formula —CqH2qL in which q is a number from 2 to 8 and L is an optionally quarternized amino group chosen from the following groups:

N(R2)-CH2-CH2-N(R2)2;

N(R2)2,

N+(R2)3Q-,

N+(R2) (H)2Q-,

N+(R2)2HQ\

N(R2)-CH2-CH2-N+(R2)(H)2 Q\ in which R2 may denote a hydrogen atom, a phenyl, a benzyl or a saturated monovalent hydrocarbon-based group, for example a C1-C20 alkyl group, and Q" represents a halide ion, for instance fluoride, chloride, bromide or iodide.

In particular, the amino silicones corresponding to the definition of formula (I) are chosen from the compounds corresponding to formula (II) below:

(II)

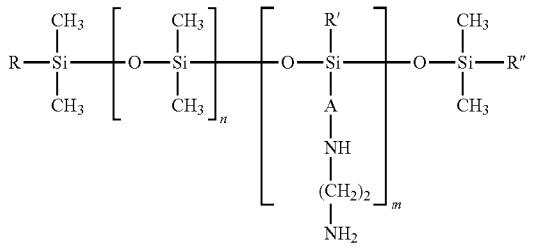

in which R, R' and R", which may be identical or different, denote a $C_1$-$C_4$ alkyl group, preferably $CH_3$; a $C_1$-$C_4$ alkoxy group, preferably methoxy; or OH; A represents a linear or branched, $C_3$-$C_8$ and preferably $C_3$-$C_6$ alkylene group; m and n are integers dependent on the molecular weight and whose sum is between 1 and 2000.

According to a first possibility, R, R' and R", which may be identical or different, represent a $C_1$-$C_4$ alkyl or hydroxyl group, A represents a $C_3$ alkylene group and m and n are such that the weight-average molecular mass of the compound is between 5000 and 500000 approximately. Compounds of this type are referred to in the CTFA dictionary as "amodimethicones".

According to a second possibility, R, R' and R", which may be identical or different, each represent a $C_1$-$C_4$ alkoxy or hydroxyl group, at least one of the groups R or R" is an alkoxy group and A represents a $C_3$ alkylene group. The hydroxy/alkoxy mole ratio is preferably between 0.2/1 and 0.4/1 and advantageously equal to 0.3/1. Moreover, m and n are such that the weight-average molecular mass of the compound is between 2000 and $10^6$. More particularly, n is between 0 and 999 and m is between 1 and woo, the sum of n and m being between 1 and woo.

In this category of compounds, mention may be made, inter alia, of the product Belsil® ADM 652 sold by the company Wacker.

According to a third possibility, R and R", which are different, each represents a $C_1$-$C_4$ alkoxy or hydroxyl group, at least one of the groups R or R" being an alkoxy group, R' representing a methyl group and A representing a $C_3$ alkylene group. The hydroxy/alkoxy mole ratio is preferably between 1/0.8 and 1/1.1 and advantageously equal to 1/0.95. Moreover, m and n are such that the weight-average molecular mass of the compound is between 2000 and 200000. More particularly, n is between 0 and 999 and m is between 1 and 1000, the sum of n and m being between 1 and 1000.

More particularly the product Fluid WR® 1300 sold by the company Wacker may be mentioned.

Note that the molecular mass of these silicones is determined by gel permeation chromatography (ambient temperature, polystyrene standard; μ styragem columns; eluent THF; flow rate 1 mm/minute; 200 μl of a solution containing 0.5% by weight of silicone in THF are injected, and detection is performed by refractometry and UV-metry).

A product corresponding to the definition of formula (I) is in particular the polymer known in the CTFA dictionary as "trimethylsilyl amodimethicone", corresponding to formula (III) below:

(III)

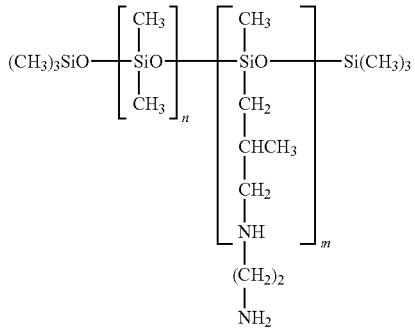

(in which n and m have the meanings given above in accordance with formula (I).

Such compounds are described, for example, in patent EP 95238. A compound of formula (III) is sold, for example, under the name Q2-8220 by the company OSI.

(b) the compounds corresponding to formula (IV) below:

(IV)

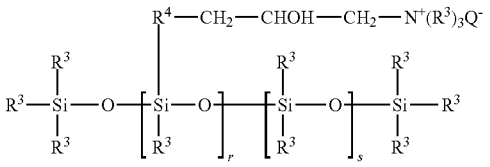

in which:

$R^3$ represents a $C_1$-$C_{18}$ monovalent hydrocarbon-based group, and in particular a $C_1$-$C_{18}$ alkyl or $C_2$-$C_{18}$ alkenyl group, for example methyl, $R^4$ represents a divalent hydrocarbon-based group, especially a $C_1$-$C_{18}$ alkylene group or a divalent $C_1$-$C_{18}$, and for example $C_1$-$C_8$, alkylenoxy group, Q" is a halide ion, in particular chloride;

r represents a mean statistical value from 2 to 20 and in particular from 2 to 8, s represents a mean statistical value from 20 to 200 and in particular from 20 to 50.

Such compounds are described more particularly in U.S. Pat. No. 4,185,087.

A compound falling within this class is the product sold by the company Union Carbide under the name Ucar Silicone ALE 56.

(c) quarternary ammonium silicones especially of formula (V):

(V)

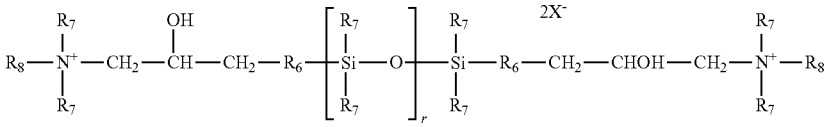

in which:

$R_7$, which may be identical or different, represent a monovalent hydrocarbon-based group containing from 1 to 18 carbon atoms, and in particular a $C_1$-$C_{18}$ alkyl group, a $C_2$-$C_{18}$ alkenyl group or a ring comprising 5 or 6 carbon atoms, for example methyl, $R_6$ represents a divalent hydrocarbon-based group, especially a $C_1$-$C_{18}$ alkylene group or a divalent $C_1$-$C_{18}$, and for example $C_1$-$C_8$, alkylenoxy group linked to the Si via an Silicon carbon (SiC) bond, $R_8$, which may be identical or different, represent a hydrogen atom, a monovalent hydrocarbon-based group containing from 1 to 18 carbon atoms, and in particular a $C_1$-$C_{18}$ alkyl group, a $C_2$-$C_{18}$ alkenyl group or a group —$R_6$—$NHCOR_7$;

X" is an anion such as a halide ion, especially chloride, or an organic acid salt (acetate, etc.);

r represents a mean statistical value from 2 to 200 and in particular from 5 to 100.

These silicones are described, for example, in patent application EP-A-0530974.

d) the amino silicones of formula (VI) below:

(VI)

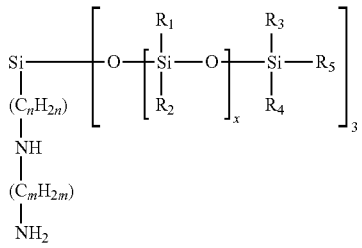

in which:

$R_1$, R2, R3 and $R_4$, which may be identical or different, denote a $C_1$-$C_4$ alkyl group or a phenyl group, $R_5$ denotes a $C_1$-$C_4$ alkyl group or a hydroxyl group, n is an integer ranging from 1 to 5, m is an integer ranging from 1 to 5, and x is chosen such that the amine number is between 0.01 and 1 meq/g.

When these compounds are used, one particularly advantageous embodiment involves their combined use with cationic and/or nonionic surfactants.

By way of example, use may be made of the product sold under the name Cationic Emulsion DC939 by the company Dow Corning, a cationic surfactant, namely trimethylcetylammonium chloride and a nonionic surfactant of formula $C_{13}H_{27}$—$(OC_2H_4)_{12}$—OH, known under the CTFA name Trideceth-12.

Another commercial product that may be used according to the invention is the product sold under the name Dow Corning Q27224 by the company Dow Corning, comprising, in combination, trimethylsilyl amodimethicone of formula (II) described above, above nonionic surfactant of formula $C_8H_{17}$—$C_6H_4$—$(OCH_2CH_2)_{40}$—OH, known under the CTFA name Octoxynol-40, a second nonionic surfactant of formula $C_{12}H_{25}$—$(OCH_2$—$CH_2)_6$—OH, known under the CTFA name Isolaureth-6, and propylene glycol.

Amino silicones are present in the composition in the amount of 0.1-10 w/w %, especially in an amount of 0.1-5 w/w %.

Method of Applying the Liquid Composition on a Textile

More particularly the present invention relates to a method of enhancing the water repellency of textile and/or its ability repel water soluble dirt, comprising the steps of:

a) Applying an emulsified liquid composition on a textile, wherein said emulsified liquid composition consists of:
   - Water
   - Alkylalkoxysilane with said alkyl chain having a length of 10-30 carbons or for example 12-30 carbons
   - At least one emulsifier or thickener or surfactant or stabilizer
   - a water soluble acid catalyst;
   - and unavoidable impurities b) Optionally, adjusting amount of formulation applied on textile c) Drying the treated textile until dry d) Curing the treated textile at a temperature of between 100-200° C.

e) Optionally, removing the non-reacted formulation residue from the treated textile by washing with water and then optionally redrying.

In one embodiment the present invention relates to a method of enhancing the water repellency of textile, comprising:

An application method for rendering a textile durable water repellent and/or water soluble dirt repellent comprising the steps of:

a) Applying an emulsified liquid composition with a pH 1.8-4.3 on a textile, wherein said emulsion is storable as an emulsion without separating into phases and is consisting of:

Water 80-97 (w/w %) of total amount emulsified liquid composition trialkylalkoxysilane with said alkyl chain having a length of 12-16 carbons and the alkoxy chains have a carbon chain of 1-3 carbons and wherein said alkoxyalkylsilane is present in an amount of 2-8 w/w % of total amount emulsified liquid composition At least one emulsifier or a combination of emulsifiers in an amount of 0.9-1.1 w/w % of the total amount emulsified liquid composition a water soluble organic acid catalyst pKa<4;

and unavoidable impurities f) Optionally, adjusting the amount of the composition applied on textile g) Drying the treated textile until dry h) Curing the treated textile at a temperature of between 100-200° C.

i) Optionally, removing the non-reacted composition residue from the treated textile by washing with water and then optionally redrying.

The method of the invention can be incorporated by using a standard foulard, a padding machine or similar liquid application machines in a textile production process, or a spraying, coating, or vacuum-pressure impregnation process.

According to a further method of the invention softness and durability and enhanced water repellency is obtained by the steps a) Applying an emulsified liquid composition on a textile, wherein said emulsified liquid composition consists of:

Water

Alkylalkoxysilane with said alkyl chain having a length of 10-30 carbons or for example 12-30 carbons At least one emulsifier or thickener or surfactant or stabilizer a water soluble acid catalyst;

and unavoidable impurities b) Optionally adding to the composition amino silicones for softness and durability enhancement of the water repellency c) Optionally, adjusting amount of formulation applied on textile d) Drying the treated textile until dry e) Curing the treated textile at a temperature of between 100-200° C.

f) Optionally, removing the non-reacted formulation residue from the treated textile by washing with water and then optionally redrying The textile material can be contacted with the silanization composition in any suitable manner, such as by dipping, padding application by roller or brush, coating and spraying. The silanization composition can be brought in contact with the textile material in a manner so as to substantially fully wet (soak) the material or only wet the material to a desired depth from the face of the material to which it is applied.

According to the method of the invention, the drying is continued until the fabric is substantially dry, that is, has a content of water below 5% by weight and even below 2% by weight. In this application, "drying" includes evaporation of water; "substantially dry" means substantially devoid of water.

An important feature of the method of the invention is the curing temperature, which is at least 100° C., preferably at least 120° C., more preferred at least 140° C. or 150° C., and even up to 200° C. The curing temperature according to the present invent ion is between 100-200° C. or between 130-180° C. The curing time is about inversely proportional to the curing temperature. Thus, curing at higher temperatures can be carried out in a correspondingly shorter time, such as in a few minutes or in about from 1 min to 3 min in a pre-heated oven at a temperature of from 150° C. to 200° C. A person skilled in the art will realize that air convection during drying, the thickness and density of the textile material, and other physical parameters of the material, will influence the curing time at a given drying temperature.

Uses of the Emulsified Liquid Composition

The present invention also includes the use of the emulsified liquid composition according to the invention to make a textile durable water resistance and also the use of a textile treated using the application method according to the present invention to make a textile durable dirt repellant towards repellency for water soluble dirt for example but not limited to soil stains or stains of ketchup, coffee or wine or water soluble stains.

DESCRIPTION OF PREFERRED EMBODIMENTS

Materials

Malic acid, acetic acid, citric acid, glyoxylic acid, puruvic acid and maleic acid, Sigma Aldrich.

$NaHCO_3$, Sigma Aldrich.

Tegosoft PC 41 (polyglycerol esters of capric acids HLB~14), Evonik Industries AG.

Hexadecyl trimethoxy silane (KH580), Zhejiang Feidian Chemical Co., Ltd.

Lutensol TO7 (ethoxylates of saturated iso-C13 alcohol) HLB~12, Lutensol TO5 (ethoxylates of saturated iso-C13 alcohol) HLB~10.5 and Dehydol LS3N (fatty alcohol C12-C14 ethoxylated) HLB~12, BASF Corp.

Ethoquad C/25 (Cocoalkylmethyl[polyoxyethylene (15)] ammonium chloride) HLB~30, AkzoNobel Chemicals ltd.

Brij S2 (ethoxy (2) stearyl ether) HLB~4.9, Croda Corp.

Isooctyl trimethoxy silane, n-octadecyl trimethoxy silane and n-dodecyl trimethoxy silane, ABCR GmbH &Co KG.

n-propyl trimethoxy silane, Alfa Aesar GmbH &Co KG.

IKA ultra turrax T 25 digital disperser with S25 N-25G/1713300 dispersing element, manufactured by IKA-Werke GmbH & Co. KG.

Fermaks TS 8136 oven.

Phenomenal pH 1000H pH meter, VWR int. LLC.

ASE5020 is a macroemulsion of a reactive amino silicone sold by Flexichem Pty Ltd Standard Methods Used Determination of resistance to surface wetting (spray test) of fabrics: European Standard EN 24 920 (ISO 4920:1981). Principle: A specified amount of water is sprayed on a textile specimen mounted on a ring. The specimen is disposed at an angle of 45° in respect to the nozzle. The centre of the standardized nozzle is disposed at a given distance above the centre of the specimen. A given amount of water is filled in a reservoir disposed above the nozzle and in communication with it. The spray rating is determined visually and/or photographically. The stepwise spray rating scale of ISO 1-5 corresponds to 50-100% of the specimen having withstood wetting.

The scale correlation is 100% (ISO 5), 97.5% (ISO −5), 92.5% (ISO+4), 90% (ISO 4), 87.5% (ISO −4), 82.5% (ISO+3), 80% (ISO 3), 77.5% (ISO −3), 72.5% (ISO+2), 70% (ISO 2), 66.67% (ISO −2), 56.67% (ISO+1), 50% (ISO 1) of the specimen having withstood wetting (see FIG. 1 for an illustrative example of ISo 5-1)

Fabrics were rinsed in a water rinse program in a washing machine prior evaluation.

Drying of fabrics was made in a preheated Fermaks TS 8136 oven at 150° C. for 5 minutes.

The water-repellency properties of the treated textile before and after machine washing with an aqueous solution of a IEC reference detergent B were evaluated (washing temperature 40° C./duration approximately 90 minutes) by testing the textile with the standardized tests SS-EN 24 920

These examples are intended to illustrate the invention to those skilled in the art and should not be interpreted as limiting the scope of the invention set forth in the claims. All percentages in these examples are weight percentages, unless otherwise indicated General Method for Emulsion Compositions Used in Experiments Emulsions with Different pH Values In a beaker 1 w/w % Emulsifier, 5 w/w % hydrophobizing agent and "water a" 50 w/w % of total amount of emulsifying solution were charged and the mixture was homogenized at 10.000 RPM for 15 minutes using an IKA ultra turrax T 25 digital disperser with S25 N-25G/1713300 dispersing element (manufactured by IKA-Werke GmbH & Co. KG). Thereafter the specified w/w % amount of acid catalyst was dissolved in an amount of w/w % "water b", see (table 1) and added under homogenization to the above prepared mixture of hydrophobizing agent. The mixture was homogenized at 10.000 RPM for 15 minutes to yield the desired emulsion.

The amount "water b" content is calculated after amount of acid is decided. Acid content may vary (pH is measured and must be between pH 1.9-4). "water b" content is added after acid is added to reach 100 w/w % of total weight of emulsion (larger amount acid, less "water b" content added).

Where applicable, the emulsion was neutralized by mixing in the specified w/w % amount of sodium hydrogen carbonate according to table 1.

Examples of the Invention Will Now Below be Shown Together with Comparative Examples:

The examples according to the invention included below are intended to be exemplary and illustrative, not limiting in scope.

TABLE 1

Preparation of compositions with different pH values.

| | |
|---|---|
| Exp 1: | 2 g Tegosoft PC 41 (1% w/w); 7 g malic acid (3.5% w/w), 10 g KH580 (5% w/w), "water a" = 100 g, "water b" = 81 g. pH: 2.137. (Total amount emulsified liquid composition = 200 g) |
| Exp 2: | 2 g Tegosoft PC 41 (1% w/w); 2.5 g malic acid (1.25% w/w), 10 g KH580 (5% w/w), $H_2O$ a = 100 g, $H_2O$ b = 85.5 g. pH: 2.359 (Total amount emulsified liquid composition = 200 g) |
| Comparative Exp 3: | 2 g Tegosoft PC 41 (1% w/w); No acid, 10 g KH580 (5% w/w), $H_2O$ a = 100 g, $H_2O$ b = 88 g. pH: 4.222 (Total amount emulsified liquid composition = 200 g) |
| Exp 4: | 2 g Tegosoft PC 41 (1% w/w); 12 g malic acid (6% w/w), 10 g KH580 (5% w/w), $H_2O$ a = 100 g, $H_2O$ b = 76 g. pH: 1.96 (Total amount emulsified liquid composition = 200 g) |
| Comparative Exp 5: | 2 g Tegosoft PC 41 (1% w/w); 7 g malic acid (3.5% w/w), 10 g KH580 (5% w/w), $H_2O$ a = 100 g, $H_2O$ b = 81 g. pH: 2.137 where after 6.5 g of $NaHCO_3$ was added to achieve pH: 4.782. (Total amount emulsified liquid composition = 200 g) |
| Comparative Exp 6: | 2 g Tegosoft PC 41 (1% w/w); 7 g malic acid (3.5% w/w), 10 g KH580 (5% w/w), $H_2O$ a = 100 g, $H_2O$ b = 81 g. pH: 2.137 where after 8.5 g of $NaHCO_3$ was added to achieve pH: 7.022. (Total amount emulsified liquid composition = 200 g) |

pH values were measured using phenomenal pH 1000 H pH meter (VWR int. LLC) at a temperature of 23° C. and a relative humidity RH of 50%. The pH meter was two point calibrated (pH 4 and 7) prior measurements. Exp 1-4 are according to the invention.

The emulsions were applied to pieces measuring 20×20 cm of polyester:cotton 65:35 fabric (white satin weave, 187 g/m$^2$) by a process comprising dipping in emulsion, squeezing (wet uptake approximately 80% of dry fabric), heating and rinsing in water, see table 2. The degree of water repellency was determined according to SS-EN 24 920, see table 3.

TABLE 2

Wet uptake of textile (using emulsions described in table 1).

| Emulsion | Untreated fabric weight (g) | Wet fabric weight (g) (wet uptake %) |
|---|---|---|
| Exp 1: | 6.722 | 12.01 (78.7%) |
| Exp 2: | 6.832 | 12.20 (78.6%) |
| Exp 3: | 6.857 | 11.88 (73.3%) |
| Exp 4: | 7.298 | 13.35 (82.9%) |
| Comparative exp 5: | 6.984 | 12.63 (80.8%) |
| Comparative exp 6: | 7.916 | 14.53 (83.6%) |

According to the results shown in table 3 it can clearly be seen that the best hydrophobization effect is achieved using emulsions with low pH or a pH below 4.3. However using too low pH (pH below 2) will result in some discoloring of the fabric, as will also be the case when the pH is too high, (pH higher than 4), the latter will also result in low spray test scores, i.e. % of the specimen having withstood wetting.

TABLE 3

Textile treated with emulsions according to Table 1 and 2 according to the application method according to the invention
Table 3 shows different ISO 4920 spray test = values (5-1) after wash 1-5.

| Fabric | Emulsion No. pH | Prior rinse | $H_2O$ rinse | Wash 1 | Wash 2 | Wash 3 | Wash 4 | Wash 5 | Comments on treated fabrics |
|---|---|---|---|---|---|---|---|---|---|
| White, PE:C 65:35, satin weave | Exp 1 pH: 2.137 | 1 | 5 | +4 | +4 | 4 | +3(4) | +3(+4) | Discoloured: No very slight slightly strongly discoloured |
| White, PE:C 65:35, satin weave | Exp 2 pH: 2.359 | 1 | +4 | 4 | +4 | 4 | 3(+3/−4) | 3(−4) | Discoloured: No very slight slightly strongly discoloured |
| White, PE:C 65:35, satin weave | Comparative Exp 3 pH: 4.222 | 0 | 0 | — | — | — | — | — | Discoloured: No very slight slightly strongly discoloured |
| White, PE:C 65:35, satin weave | Exp 4 pH: 1.96 | 1 | 5 | 5 | +4 | −4 | −3(+3) | −3(+3/−4) | Discoloured: No very slight slightly strongly discoloured |
| White, PE:C 65:35, satin weave | Comparative exp 5 pH: 4.782 | 0-1 | 1 | — | — | — | — | — | Discoloured: No very slight slightly strongly discoloured |
| White, PE:C 65:35, satin weave | Comparative exp 6 pH: 7.022 | 0-1 | 3/+3 | 2 | +1 | +1 | 1(1) | 1(+1) | Discoloured: No very slight slightly strongly discoloured |

Values within parenthesis indicate spray test score after ironing.

Parameters: Curing 5 min/150° C.; Washing 40° C./90 min; Drying in between washes 150° C./15 min. Omitted values (—) are due to too low spray test score.

Table 3 shows experimental data of the emulsions described in table 2.

Table 4 Different Emulsifiers

Emulsions (table 4) were prepared according to the procedure described in example 1 and used in the same manner to treat 20×20 cm pieces of polyester:cotton 65:35 fabric, see table 5. Exp 7, 8 and Exp 1 are all examples according to the present invention.

TABLE 4

Examples of emulsifying solution according to the invention with different emulsifiers.

| | |
|---|---|
| Exp 7: | Lutensol TO7 (0.4% w/w), Lutensol TO5 (0.6% w/w), Malic acid (3.5% w/w), KH580 (5% w/w) and $H_2O$ (90.5% w/w) (water a 50% w/w, water b 40.5% w/w). "water b". (100-0, 4-0, 6-3, 5-5 = 90.5% w/w H2O) |
| Exp 8: | Dehydol LS3N (0.1% w/w), Ethoquad C/25 (0.5% w/w), Brij S2 (0.5% w/w), Malic acid (3.5% w/w), KH580 (5% w/w) and $H_2O$ (90.4% w/w) (water a 50% w/w, water b 40.4% w/w). "water b". (100-0.1-0.5-0.5-3.5-5 = 90.4% w/w H2O |
| Exp 1: | Tegosoft PC 41 (1% w/w), Malic acid (3.5% w/w), KH580 (5% w/w) and $H_2O$ (90.5% w/w) (water a 50% w/w, water b 40.5% w/w). "water b". (90.5% w/w H2O). |

TABLE 5

Wet uptake of textile (using emulsions described in Table 4).

| Emulsion | Untreated fabric weight (g) | Wet fabric weight (g) (wet uptake %) |
|---|---|---|
| 7: | 6.973 | 12.48 (79%) |
| 8: | 7.135 | 12.88 (80.5%) |
| 1: | 7.103 | 12.48 (75.7%) |

The results in table 6 (using emulsions from table 4) demonstrate that the choice of emulsifier plays a minor role on the outcome of the hydrophobicity of the treated fabric and the durability of it on the fabric when subjected to machine washing using detergent at 40° C.

TABLE 6

Textile treated with emulsions according to Table 4 and 5 according to the application method according to the invention
Table 6 shows different ISO 4920 spray test = values (5-1) after wash 1-5.

| Fabric | Emulsion | Prior rinse | $H_2O$ rinse | Wash 1 | Wash 2 | Wash 3 | Wash 4 | Wash 5 | Parameters |
|---|---|---|---|---|---|---|---|---|---|
| White, PE:C 65:35, satin weave | 7 | 0 | +4 | −5 | −5 | 5 | 5 | +4 | Curing 5 min/150° C. Washing 40° C./ 90 min Drying 150° C./ 5 min |
| White, PE:C 65:35, satin weave | 8 | 2 | 3 | +4/−5 | −5 | 5 | 5 | 5 | Curing 5 min/150° C. Washing 40° C./ 90 min Drying 150° C./ 5 min |
| White, PE:C 65:35, satin weave | 1 | 1 | −5 | −5 | −5 | 5 | −5 | 5 | Curing 5 min/150° C. Washing 40° C./ 90 min: Drying 150° C./ 5 min |

Table 7—Temperature and Different Curing Time

Emulsion 1 (Tegosoft PC 41 (1% w/w), malic acid (3.5% w/w), KH580 (5% w/w) and $H_2O$ rest.) was used to treat polyester:cotton 65:35 fabric (Table 7) using different temperatures and curing time. The results are summarized in Table 8 and show that longer curing time will enhance the durability and hydrophobicity of the treated fabric. To those skilled in the art it will be obvious that low curing temperature requires long curing time and that high curing temperature requires short curing time, compare Table 7, 8 and FIG. 1.

TABLE 7

Wet uptake of textile (using emulsions described in Table 1, exp 1) comparing effect of different curing time for the same emulsion

| Emulsion | Untreated fabric weight (g) | Wet fabric weight (g) (wet uptake %) | Curing time/Temperature |
|---|---|---|---|
| See exp 1, Table 1 | 7.229 | 12.98 (79.6%) | 20 min/100° C. |
| See exp 1, Table 1 | 7.284 | 13 (78.5%) | 5 min/100° C. |

Table 9—Use of Alkoxysilanes with Different Chain Lengths.

In order to assess the effectiveness of the hydrophobizing agent several emulsions were prepared according to the procedure describe in example 1 employing different alkyl chain lengths on the alkoxy silane moiety, see Table 9. These were subsequently used in the same manner previously described to hydrophobize polyester:cotton fabric 65:35. It is clearly shown that longer alkyl chain on the alkoxy silane will favor the durable hydrophobicity of the treated fabric. The results are summarized in Tables 10 and 11.

TABLE 9

Emulsions containing different kinds of alkyl alkoxy silanes.

| | |
|---|---|
| Comparative Exp 9: | Tegosoft PC 41 (1% w/w), malic acid (3.5% w/w), isooctyl trimethoxy silane (5% w/w) and $H_2O$ rest. (C8) |
| Exp 10: | Tegosoft PC 41 (1% w/w), malic acid (3.5% w/w), n-octadecyl trimethoxy silane (5% w/w) and $H_2O$ rest. (C18) |
| Exp 11: | Tegosoft PC 41 (1% w/w), malic acid (3.5% w/w), n-dodecyl trimethoxy silane (5% w/w) and $H_2O$ rest. (C12) |
| Comparative Exp 12: | Tegosoft PC 41 (1% w/w), malic acid (3.5% w/w), n-propyl trimethoxy silane (5% w/w) and $H_2O$ rest. C(3) |
| Exp 1: | Tegosoft PC 41 (1% w/w), malic acid (3.5% w/w), KH580 (5% w/w) and $H_2O$ rest. (C16) |

Exp 10, 11 and 1 are according to the invention. Exp 9 and 12 are comparative examples

TABLE 8

Textile treated with emulsions according to Table 1 and 7 according to the application method according to the invention
Table 8 shows different ISO 4920 = values (5-1) after wash 1-5.

| Fabric | Emulsion | Prior rinse | $H_2O$ rinse | Wash 1 | Wash 2 | Wash 3 | Wash 4 | Wash 5 | Application method Parameters |
|---|---|---|---|---|---|---|---|---|---|
| White, PE:C 65:35, satin weave | 1 | 0 | +4 | −5 | +4/−5 | +4 | +3/−4 | +3/−4 | Curing 20 min/100° C. Washing 40° C./ 90 min: Drying 150° C./5 min |
| White, PE:C 65:35, satin weave | 1 | 0 | +2/3 | 3 | +3 | +3/−4 | +3 | 3 | Curing 5 min/100° C. Washing 40° C./ 90 min: Drying 150° C./5 min |

TABLE 10

| Wet uptake of textile (using emulsions described in Table 9) | | |
|---|---|---|
| Emulsion | Untreated fabric weight (g) | Wet fabric weight (g) (wet uptake %) |
| Exp 9: | 7.095 | 12.7 (79%) |
| Exp 10: | 7.268 | 13 (78.9%) |
| Exp 11: | 7.163 | 12.6 (75.9%) |
| Exp 12: | 7.206 | 12.8 (77.6%) |
| Exp 1: | 7.103 | 12.48 (75.7%) |

TABLE 11

Textile treated with emulsions according to Table 9 and 10 according to the application method according to the invention
Table 11 shows different ISO 4920 spray test = values (5-1) after wash 1-5.

| Fabric | Emulsion | Prior rinse | $H_2O$ rinse | Wash 1 | Wash 2 | Wash 3 | Wash 4 | Wash 5 | Application method Parameters |
|---|---|---|---|---|---|---|---|---|---|
| White, PE:C 65:35, satin weave | 9 | 1 | 1 | 1 | | — | — | — | Curing 5 min/150° C. Washing 40° C./ 90 min Drying 150° C./ 5 min |
| White, PE:C 65:35, satin weave | 10 | 1 | −5/+4 | +4/−5 | 5 | 5 | 5 | −5 | Curing 5 min/150° C. Washing 40° C./ 90 min Drying 150° C./ 5 min |
| White, PE:C 65:35, satin weave | 11 | 1 | 1 | 1 | — | — | — | — | Curing 5 min/150° C. Washing 40° C./ 90 min Drying 150° C./ 5 min |
| White, PE:C 65:35, satin weave | 12 | 0 | 1 | 1 | | — | — | — | Curing 5 min/150° C. Washing 40° C./ 90 min Drying 150° C./ 5 min |
| White, PE:C 65:35, satin weave | 1 | 1 | −5 | −5 | −5 | 5 | −5 | 5 | Curing 5 min/150° C. Washing 40° C./ 90 min Drying 150° C./ 5 min |

Use of Different Kinds of Acids and Emulsion Performance on Different Fabrics

Emulsions containing other acids than malic acid and varying amount of emulsifier and silane were made using the same procedure as described in example 1, see table 13. Pieces 20×20 cm of different kinds of fabric were subjected to the emulsions as previously described, cured, rinsed, washed and spray tested, see table 12-15 for a summary of the results obtained.

TABLE 13

| Emulsions containing different kinds of alkyl alkoxy silanes. | |
|---|---|
| Exp 13: | Tegosoft PC 41 (0.7% w/w), malic acid (3.5% w/w), hexadecyl trimethoxysilane (5% w/w) and $H_2O$ (90.8% w/w) (water a 50% w/w, water b 40.8% w/w). |
| Exp 14: | Tegosoft PC 41 (1% w/w), citric acid (2.5% w/w), hexadecyl trimethoxysilane (5% w/w) and $H_2O$ (91.5% w/w) (water a 50% w/w, water b 41.5% w/w). |
| Exp 15: | Tegosoft PC 41 (1% w/w), maleic acid (1.5% w/w), hexadecyl trimethoxysilane (5% w/w) and $H_2O$ (92.5% w/w) (water a 50% w/w, water b 42.5% w/w). |

TABLE 13-continued

| Emulsions containing different kinds of alkyl alkoxy silanes. | |
|---|---|
| Exp 16: | Tegosoft PC 41 (1% w/w), glyoxylic acid (5% w/w), hexadecyl trimethoxysilane (7% w/w) and $H_2O$ (87.% w/w) (water a 50% w/w, water b 37% w/w). |
| Exp 17: | Tegosoft PC 41 (1% w/w), malic acid (3.5% w/w), hexadecyl trimethoxysilane (7% w/w) and $H_2O$ (88.5% w/w) (water a 50% w/w, water b 38.5% w/w). |

TABLE 12

| Fabrics | Emulsion | Prior rinse | $H_2O$ rinse | Wash 1 | Wash 2 | Wash 3 | Wash 4 | Wash 5 | Application method Parameters |
|---|---|---|---|---|---|---|---|---|---|
| White, PE:C 65:35, satin weave | Tegosoft PC 41 (1% w/w), Acetic acid (20% w/w), KH580 (5% w/w) and $H_2O$ rest. | 0 | 2 | 2 | — | — | — | — | Curing 5 min/ 150° C. Washing 40° C./ 90 min Drying 150° C./ 5 min |

TABLE 13-continued

| Emulsions containing different kinds of alkyl alkoxy silanes. | |
|---|---|
| Exp 18: | Tegosoft PC 41 (1% w/w), puruvic acid (1.75% w/w), hexadecyl trimethoxysilane (3.5% w/w) and $H_2O$ (93.75% w/w) (water a 50% w/w, water b 43.75% w/w). |
| Exp 19: | Tegosoft PC 41 (1% w/w), citric acid (2.5% w/w), hexadecyl trimethoxysilane (7% w/w) and $H_2O$ (89.5% w/w) (water a 50% w/w, water b 39.5% w/w). |

TABLE 13-continued

| Emulsions containing different kinds of alkyl alkoxy silanes. | |
|---|---|
| Exp 20: | Tegosoft PC 41 (1% w/w), malic acid (5% w/w), hexadecyl trimethoxysilane (5% w/w) and $H_2O$ (89% w/w) (water a 50% w/w, water b 39% w/w). |

TABLE 14

| Fabrics | Emulsion (see table 13 and 9) | Prior rinse | $H_2O$ rinse | Wash 1 | Wash 5 | Application method Parameters |
|---|---|---|---|---|---|---|
| 100% CO Satin 132 g/m2 White | Exp 13 | 1 | 5 | −5 | +3 | Curing 5 min/150° C. Washing 40° C./ 90 min Drying 150° C./5 min |
| 100% CO Satin 132 g/m2 White | Exp 14 | 1 | 5 | 4 | −3 | Curing 5 min/150° C. Washing 40° C./ 90 min Drying 150° C./5 min |
| 100% CO Satin 132 g/m2 White | Exp 15 | 3 | −5 | −5 | 3 | Curing 5 min/150° C. Washing 40° C./ 90 min Drying 150° C/5min |
| Spandex:Nylon 10:90 Black | Exp 16 | 1 | 5 | 5 | 5 | Curing 5 min/150° C. Washing 40° C./ 90 min Drying 150° C./5 min |
| Spandex:Nylon 10:90 Black | Exp 17 | +2 | +4 | 5 | −5 | Curing 5 min/150° C. Washing 40° C./ 90 min Drying 150° C./5 min |
| Spandex:Nylon 10:90 Black | Exp 18 | +2 | −5 | +4 | 3 | Curing 5 min/150° C. Washing 40° C./ 90 min Drying 150° C./5 min |
| Spandex:Nylon 10:90 Black | Exp 19 | 1 | −4 | −4 | 4 | Curing 5 min/150° C. Washing 40° C./ 90 min Drying 150° C./5 min |
| Nylon:Spandex 80:20 white | Exp 17 | 1 | 4 | 4– | 4 | Curing 5 min/150° C. Washing 40° C./ 90 min Drying 150° C./5 min |
| Nylon:Spandex 80:20 white | Exp 19 | 1 | 4 | 4+ | 4+ | Curing 5 min/150° C. Washing 40° C./ 90 min Drying 150° C./5 min |
| 100% polyester White Plain weave | Exp 20 | 4 | 5 | 5 | 5 | Curing: 150° C./5 min Washing: 40° C./90 min Drying: 150° C./5 min |
| 100% Nylon brown | Exp 1 | 1 | 5 | 5 | 4 | Curing: 150° C./4.5 min Washing: 40° C./90 min Drying: 150° C./5 min |
| 100% Cotton White Satin 145 g/m$^2$ | Exp 20 | 1 | 5 | 5 | +3 | Curing: 150° C./5 min Washing: 40° C./90 min Drying: 150° C./5 min |

TABLE 15

Table 15 illustrates the treatment (using the emulsion from exp 1) of recycled polyester fabric with emulsion 1 and the subsequent washing (20 times) with the spray test scores.

| Fabrics | Emulsion | Prior rinse | $H_2O$ rinse | Wash 1 | Wash 10 | Wash 20 | Application method Parameters |
|---|---|---|---|---|---|---|---|
| Recycled Polyester fabric White | Exp 1<br>5% KH580<br>3.5% Malic acid<br>1% TegoSoft 41<br>in $H_2O$ | +1 | +4 | 4 | 4 | −4 | Curing: 150° C./5 min<br>Washing: 40° C./90 min<br>Drying: 150° C./5 min |

Industrially Relevant Application Parameters

In a scale up experiment (FIG. 2) using emulsion 1, (containing Tegosoft PC 41 (1% w/w); malic acid (3.5% w/w), $KH_{580}$ (7.5% w/w), ("water a" 50 w/w % and "water b" (40.5% w/w)) was applied to polyester:cotton 65:35 fabric (white satin weave, 187 g/m$^2$) using a padding machine, stenter frame and drying/curing oven. The role of fabric was subsequently mounted on a jet dyeing machine and rinsed with water (18 min at 7° C. and drying at 170° C. for 4 min), where after it was dried on a stenter frame coupled to a drying oven.

The parameters used were wet uptake: 50%, Curing time and temperature 2 min/170° C. and drying time and temperature after rinsing: 2 minutes/170° C.

Figure 2:
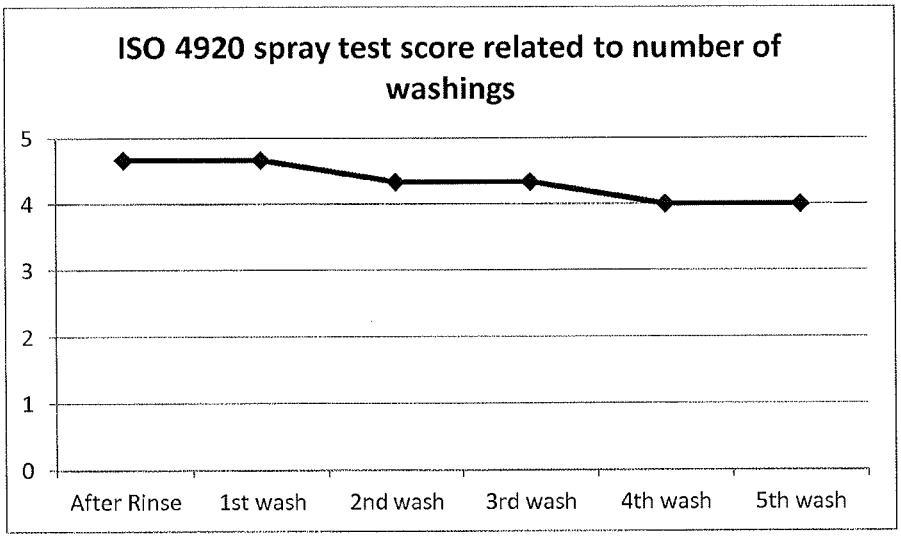
FIG. 2 shows one example according to the invention displaying ISO 4920 spray test scores and is related to the number of washings.

FIG. 2 summarizes the obtained ISO 4920 spray test results.

Staining Test

A staining test was conducted based on a test method see below which includes staining by wine, coffee and ketchup. The following staining liquids were used; instant coffee (4 g of Nescafe Lyx in 100 ml of boiling water), red wine (12.5% alcohol), Heinz ketchup, and melted dirty snow from road sides of Stockholm highways in Sweden.

The materials used were an untreated white sateen weave (65% polyester/35% cotton, 187 g/m$^2$) and the same weave having been treated with the below described emulsion in a full scale padding/curing process (50% wet-uptake, drying/curing at 170° C. for 2 min, rinsing in water in a jet-machine for 18 min at 7° C. and drying at 170° C. for 4 min, see FIG. 2).

Tegosoft PC 41 (1% w/w); malic acid (3.5% w/w), KH580 (hexadecyltrimethoxysilane) (7.5% w/w), water 88% w/w.

Both the untreated and the treated weaves were conditioned for 24 hours at 23° C. and 50% relative humidity. Two stains of 5 ml of each liquid and 40 mm of the Heinz ketchup were added to both the untreated and the treated weaves. After 1 hour one of each stain was removed with the help of a damp cloth. After 24 h the second stain was removed in the same manner. The weaves were let to dry for 24 hours in room temperature, then the stains were assessed by putting a white paper under the weaves and assess according to the following scale.

TABLE 16

Assessment legend

| | |
|---|---|
| 1 | Strong mark |
| 2 | Clear mark |
| 3 | Visible mark |
| 4 | Slightly visible mark |
| 5 | No visible mark |

TABLE 17

The results were the following:

| | Coffee 1 h | Coffee 24 h | Red wine 1 h | Red wine 24 h | Ketchup 1 h | Ketchup 24 h | Dirty snow 1 h | Dirty snow 24 h |
|---|---|---|---|---|---|---|---|---|
| Untreated weave | 1 | 1 | 1 | 1 | 2 | 2 | 1 | 1 |
| Treated weave | 4 | 3 | 5 | 3 | 5 | 4 | 4 | 4 |

As can be seen, the treated weave has an average score of 4.0 whereas the untreated weave scores 1.3. Thus the weave that has been treated with the emulsion of the invention is more repellent against water-based stains than the untreated weave.

TABLE 18

Preparation of formulations with and without amino silicone for enhanced softness and increase of water repellent durability.

| | |
|---|---|
| Exp 21: | Tegosoft PC 41 (1.25% w/w), Malic acid (3.5% w/w), KH580 (7.5% w/w) and "water b". |
| Exp 22: | Lutensol TO7 (0.4% w/w), Lutensol TO5 (0.6% w/w), Malic acid (2% w/w), KH580 (3% w/w), ASE5020 (5% w/w) and "water b". |

TABLE 19

Wet uptake of textile.

| Emulsion | Wet uptake % |
|---|---|
| 21: | 43% |
| 22: | 39% |

The treated polyamide textiles made according to the Examples 21 and 22 described herein were submitted for sensory panel evaluation. The sensory panel utilized individuals trained to compare textile products and evaluate softness. The panelists were asked to render numerical values for each Example textile regarding the stiffness attribute. Stiffness was ranked on a scale from 0, described as very soft, to 7 described as stiff/rigid.

TABLE 20

Evaluation of the stiffness/softness of treated textiles.

| Exp | Sensory panel evaluation |
|---|---|
| 21: | 3 |
| 22: | 0 |

TABLE 21

| Fabric | Exp | $H_2O$ rinse | Wash 1 | Wash 5 | Wash 10 | Wash 20 | Application method parameters |
|---|---|---|---|---|---|---|---|
| 100% Polyamide, blue, 49 g/m$^2$ | 21 | 5 | 4 | 4 | 1 | 1 | Curing 5 min/150° C. Washing 40° C./90 min: Tumble drying |
| 100% Polyamide, blue, 49 g/m$^2$ | 22 | 4 | 4 | 4 | 5 | 4 | Curing 5 min/150° C. Washing 40° C./90 min: Tumble drying |

The invention claimed is:

1. An application method, comprising the steps of:

a) applying an emulsified liquid composition on a textile to form a treated textile, wherein said emulsified liquid composition consists of:
   water;
   alkylalkoxysilane with an alkyl chain having a length of 12-18 carbon atoms;
   at least one emulsifier, surfactant, thickener and/or stabilizer;
   a water soluble acid catalyst;
   optionally amino silicones; and
   unavoidable impurities b) optionally adjusting an amount of composition applied on the textile;

c) drying the treated textile until dry;

d) curing the treated textile at a temperature of between 100-200° C.;

e) optionally removing non-reacted composition residue from the dried treated textile by washing with water and then optionally redrying the treated textile, wherein said emulsifier or a combination of said emulsifiers in said emulsified liquid composition is at a concentration of <2 w/w % in relation to a total amount of emulsified liquid composition.

2. The application method according to claim 1, wherein the emulsified liquid composition includes the amino silicones.

3. The application method according to claim 1, wherein said emulsified liquid composition has a pH between 1.8-4.3.

4. The application method according to claim 1, wherein said applying is selected from soaking, impregnating, padding, dipping, spraying, brushing, coating, rolling, or foam-application.

5. The application method according to claim 1, wherein adjusting an amount of composition applied on the textile is made using an industrial padding machine/foulard to apply the emulsified liquid composition to the textile and to control a wet uptake by adjusting nip pressure or pneumatic load adjustment of rolls of the padding machine/foulard and wherein wet uptake is 30-100% w/w % in relation to untreated textile.

6. The application method according to claim 1, wherein said alkylalkoxysilane in said emulsified liquid composition is present in a concentration of 2-10 w/w % in relation to a total amount of emulsified liquid composition.

7. The application method according to claim 1, wherein said acid catalyst in said emulsified liquid composition is at a concentration of <8 w/w % in relation to a total amount of emulsified liquid composition.

8. The application method according to claim 1, wherein the water content in said emulsified liquid composition is 80-97.5 w/w % in relation to a total amount of emulsified liquid composition.

9. The application method according to claim 1, wherein the water content in said emulsified liquid composition is lower than 80 w/w % in relation to a total amount of emulsified liquid composition and wherein an additional amount of water may be added before applying in said application method.

10. The application method according to claim 1, wherein the alkoxy group of said alkylalkoxysilane is selected from the group consisting of acetoxy, methoxy, ethoxy, n-propoxy, isopropoxy, n-butoxy, isobutoxy, and tertbutoxy.

11. The application method according to claim 1, wherein said alkylalkoxysilane has an alkyl chain with a number of carbon atoms higher than 12 but equal to or less than 18 carbons.

12. The application method according to claim 1, wherein the alkylalkoxysilane is selected from the group consisting of n-, iso, and mixtures thereof of hexadecyltrimethoxysilane and octadecyltrimethoxysilane.

13. The application method according to claim 1, wherein the alkyl chain of said alkylalkoxysilane is a linear, branched or cyclic carbon chain.

14. The application method according to claim 1, wherein said alkylalkoxysilane is selected from the group consisting of n- or iso configured hexadecyl trimethoxysilane, hexadecyltriethoxysilane, and n-octadecyltrimethoxysilane and mixtures thereof.

15. The application method according to claim 1, wherein said emulsified liquid composition has a pH of less than 3.9.

16. The application method according to claim 1, wherein said water soluble acid catalyst in said emulsified liquid composition has a pKa of 6 or less.

17. The application method according to claim 1, wherein said emulsifier in said emulsified liquid composition is a non-ionic or an ionic emulsifier.

18. The application method according to claim 1, wherein the acid catalyst is a Lewis- or a Bronstedt acid.

19. The application method according to claim 1, wherein the acid catalyst is an organic acid.

20. The application method according to claim 1, wherein the acid catalyst is selected from the group consisting of para-toluenesulfonic acid, benzenesulfonic acid, camphorsulfonic acid, malic acid, maleic acid, glyoxylic acid, citric acid, formic acid, pyruvic acid, tartaric acid, phtalic acid, acetylsalicylic acid, salicylic acid, lactic acid, dihydroxy fumaric acid, mandelic acid, malonic acid, glycolic acid, acetic acid, hydrochloric acid, sulfuric acid, and oxalic acid.

21. The application method according to claim 1, wherein drying of the treated textile is performed at a temperature of between 15-180° C. until dry.

22. The application method according to claim 1, wherein curing the treated textile is performed at a temperature of between 130-180° C.

23. A method comprising applying an emulsified liquid composition to a textile for providing the textile with durable water resistance, wherein the emulsified liquid composition consists of:

water;

alkyltrialkoxysilane with an alkyl chain having a length of 12-18 carbon atoms and with each alkoxy group comprising 1-4 carbon atoms;

at least one emulsifier, surfactant, thickener and/or stabilizer;

a water soluble acid catalyst; and unavoidable impurities.

24. The application method according to claim 23, wherein said emulsifier or a combination of said emulsifiers in said emulsified liquid composition is at concentration of <2 w/w % in relation to a total amount of emulsified liquid composition.

25. A method comprising applying an emulsified liquid composition to a textile for making the textile durable dirt repellant towards water soluble dirt, wherein the emulsified liquid composition consists of:

water;

alkyltrialkoxysilane with an alkyl chain having a length of 12-18 carbon atoms and with each alkoxy group comprising 1-4 carbon atoms;

at least one emulsifier, surfactant, thickener and/or stabilizer;

a water soluble acid catalyst; and unavoidable impurities.

* * * * *